United States Patent [19]

Jankovsky

[11] Patent Number: 4,807,763

[45] Date of Patent: Feb. 28, 1989

[54] PORTABLE, DISASSEMBLABLE STAND FOR BASEBALL BATS AND THE LIKE

[76] Inventor: Peter Jankovsky, 6 Old Dodgingtown Rd., Redding, Conn. 06896

[21] Appl. No.: 120,611

[22] Filed: Nov. 13, 1987

[51] Int. Cl.[4] ..... A47F 7/00

[52] U.S. Cl. ..... 211/60.1; 211/13; 211/196

[58] Field of Search ..... 211/1.3, 13, 14, 60.1, 211/196, 205, 70.2; 206/315.1, 315.9

[56] References Cited

U.S. PATENT DOCUMENTS

| | | | |
|---|---|---|---|
| D. 35,223 | 10/1901 | Boggs . | |
| D. 48,940 | 4/1916 | Key . | |
| D. 186,486 | 10/1959 | Pollard . | |
| D. 230,108 | 1/1974 | Sloan . | |
| D. 242,097 | 11/1976 | O'Neal . | |
| 318,336 | 5/1885 | Weidner | 211/200 X |
| 1,038,198 | 9/1912 | Randall . | |
| 1,431,611 | 10/1922 | Williams | 211/1.3 X |
| 1,763,748 | 6/1930 | Best | 211/196 X |
| 2,621,802 | 12/1952 | Stover | 211/1.3 X |
| 2,889,863 | 6/1959 | Arnold . | |
| 2,924,338 | 2/1960 | Sharp . | |
| 3,021,960 | 2/1962 | Pipe . | |
| 3,051,320 | 3/1962 | Barnett . | |
| 3,524,616 | 8/1970 | Marschak . | |
| 4,193,495 | 3/1980 | Keeley . | |
| 4,629,065 | 12/1986 | Braaten . | |

*Primary Examiner*—Robert W. Gibson, Jr.
*Attorney, Agent, or Firm*—Mattern, Ware, Stoltz & Fressola

[57] ABSTRACT

A portable, light-weight storage stand for baseball and softball bats which has two arms with eight to twelve apertures to receive bats lowered therethrough. The arms are slideably received through sector slots in the wall of a central tubular support member held vertical by base cross leg pieces engaging the tubular support member's slotted lower end. When disassembled, the arms and base pieces are stored inside the tubular support member retained by two end caps, and the packed tube may be stored in a duffel bag with the bats.

48 Claims, 2 Drawing Sheets

PORTABLE, DISASSEMBLABLE STAND FOR BASEBALL BATS AND THE LIKE

BACKGROUND OF THE INVENTION

The present invention relates to storage devices for baseball bats and the like, and more particularly to a disassemblable stand for baseball bats and the like which can be easily transported and stored.

Professional baseball teams have built-in racks for their baseball bats conveniently located in their dugouts. These built-in racks provide a convenient way for the professional teams to store their bats in an organized and easily retrievable manner. Such racks are not available at local playgrounds and ball fields where many games are played in a pickup fashion or by organized local leagues and teams. In these situations, the bats are generally strewn on the ground making them difficult to locate and creating a potential hazard for team members and other players. In addition, the bats may get dirty and/or damaged if they are left lying on the ground.

To alleviate these problems, baseball players oftentimes hang their bats on the chain fence backstop by inserting the small handle end of the bat through the chain link opening and letting the bat hang at an acute angle to the chain link fence. This will generally hold the bats satisfactorily; however, if during the course of the game, the backstop is jostled by one of the players or hit by an errant or foul ball, the bats will become dislodged from their position in the chain link fence and fall to the ground. Additionally, the bats jutting out from the backstop create a potential hazard. Furthermore, to choose a bat for hitting, a player must generally look at the top handle end of the bat which is marked with a numeral indicating the length of the bat. It is inconvenient for the player to have to remove the bat from the backstop, look at the handle end of the bat to perceive and length thereof, and replace it if it happens to be the wrong bat.

Prior art devices have addressed these problems in an unsatisfactory manner. For example, holders have been developed, such as U.S. Design Pat. No. 242,097, which can be hung directly from a chain link backstop. In many instances, the local playground and ball fields do not have such backstops thereby rendering these hang-on type devices of the prior art useless. In addition, these devices have dangerous hooks, clamps, hinges, etc. Other prior art devices such as U.S. Pat. Nos. 2,889,863, 4,193,495 and 4,629,065 are bulky making them inconvenient to use and transport.

SUMMARY OF THE INVENTION

The present invention is designed to overcome the above noted limitations that are attendant in the "prior art" and toward this end it contemplates the provision of a novel stand for baseball bats and the like which keeps the bats organized and easy to find.

It is also an object to provide such a stand which is disassemblable and does not use dangerous hooks, clamps, hinges, etc.

Another object is to provide such a device which fits conveniently into a duffel bag traditionally carried by baseball teams for their baseball bats and equipment.

It is a further object to provide such a stand for baseball bats which can be placed on practically any horizontal surface and does not require the use of a chain link fence backstop.

Still another object is to provide such a device which may be readily and economically fabricated and will enjoy a long life and operation.

It has now been found that the foregoing and related objects can be readily attained in a disassemblable stand for supporting baseball bats comprising a base adapted to rest on a horizontal surface, a main support member releasably mounted on and extending generally vertically from the base, and at least one arm piece releasably mounted and extending outwardly from the main support member. The arm piece has means thereon to support at least one baseball bat in a generally vertical position.

Desirably, one component incorporates a storage compartment accommodating the other principal components. In the preferred embodiment, the main support member has the compartment therein, and the base and the arm piece are dimensionally sized to fit within the compartment whereby the base, main support member and the arm piece can be disassembled from one another and the base and arm piece inserted within the compartment of the main support member. The main support member can be a tubular support member with the compartment as a hollow central portion thereof.

Ideally, the main support member has at least one slot therethrough and the one arm piece extends through the at least one slot and outwardly on either side of the main support member. The at least one arm piece can be two elongated arm pieces releasably mounted on and extending outwardly from the main support member. The two arm pieces can be spaced vertically from one another on the main support member and oriented at right angles relative to one another.

Additionally, the base can be provided by two cross leg members on which the main support member is releasably seated. The cross leg members can be oriented in the main support member at ninety degree angles to one another and at forty-five degree angles relative to the two arm pieces. Further, the main support member can be provided with slots at its lower end with the cross leg members fitting into the slots to form a releasable connection therebetween.

A pair of caps can be provided for covering the ends of the main support member. Each of the caps has a locking device thereon to lock it to the main support member.

The invention will be fully understood when reference is made to the following detailed description taken in conjunction with the accompanying drawings.

DETAILED DESCRIPTION OF THE PREFERRED EMBODIMENT

Figure 1:
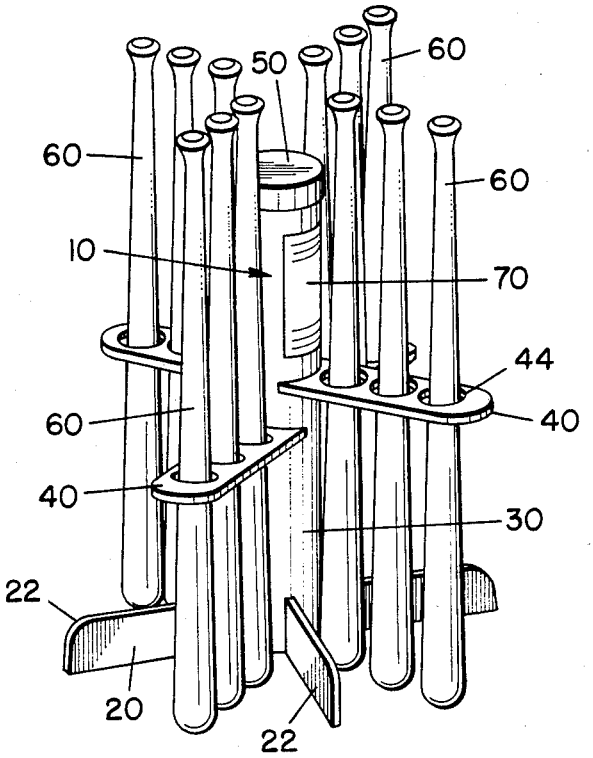
FIG. 1 is a perspective view of a disassemblable stand for baseball bats of the present invention shown supporting a plurality of baseball bats.
Figure 4:
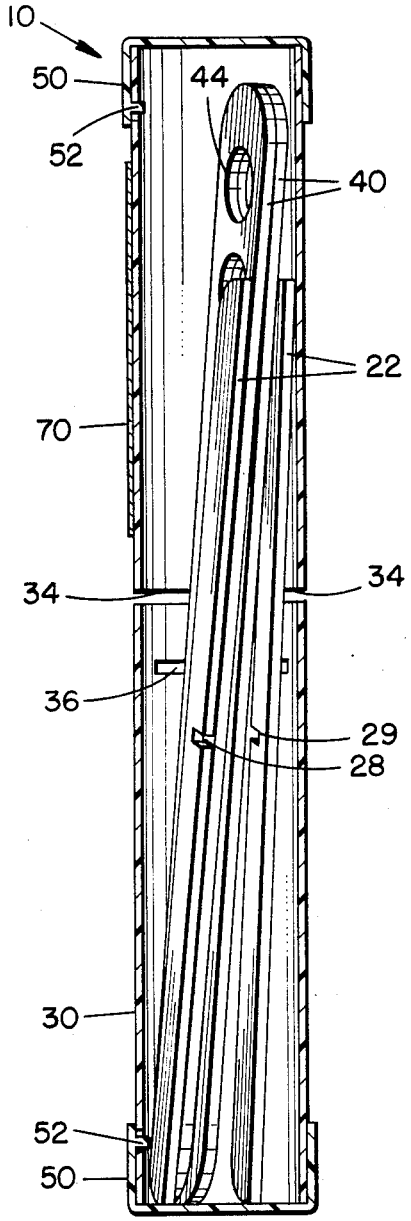
FIG. 4 is a cross-sectional view of the disassemblable stand for baseball bats of FIG. 1 shown in its packed, easily portable state with the arm pieces and base cross leg pieces inserted in the central tubular support member for storage and transport purposes.

Referring first to FIG. 1, therein is illustrated a disassemblable stand for baseball bats and the like according to the present invention and generally indicated by the numeral 10. The stand 10 has a cross leg base 20 adapted for positioning on a horizontal surface, a main central tubular support member 30 extending upwardly from the central portion of the base 20, and a pair of extending arm pieces 40 mounted on the main tubular support member 30 and extending outwardly therefrom. Sealing the upper end of the main tubular support member 30 is a cap 50. The disassemblable stand 10 is shown in use in FIG. 1 with twelve baseball bats 60 being supported thereby with their butt ends engaging the ground.

Figure 5:
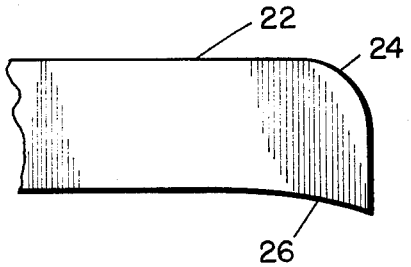
FIG. 5 is a fragmentary side elevational view of an optional elongated leg of the baseball bat stand of the present invention with dig-in type feet.
Figure 2:
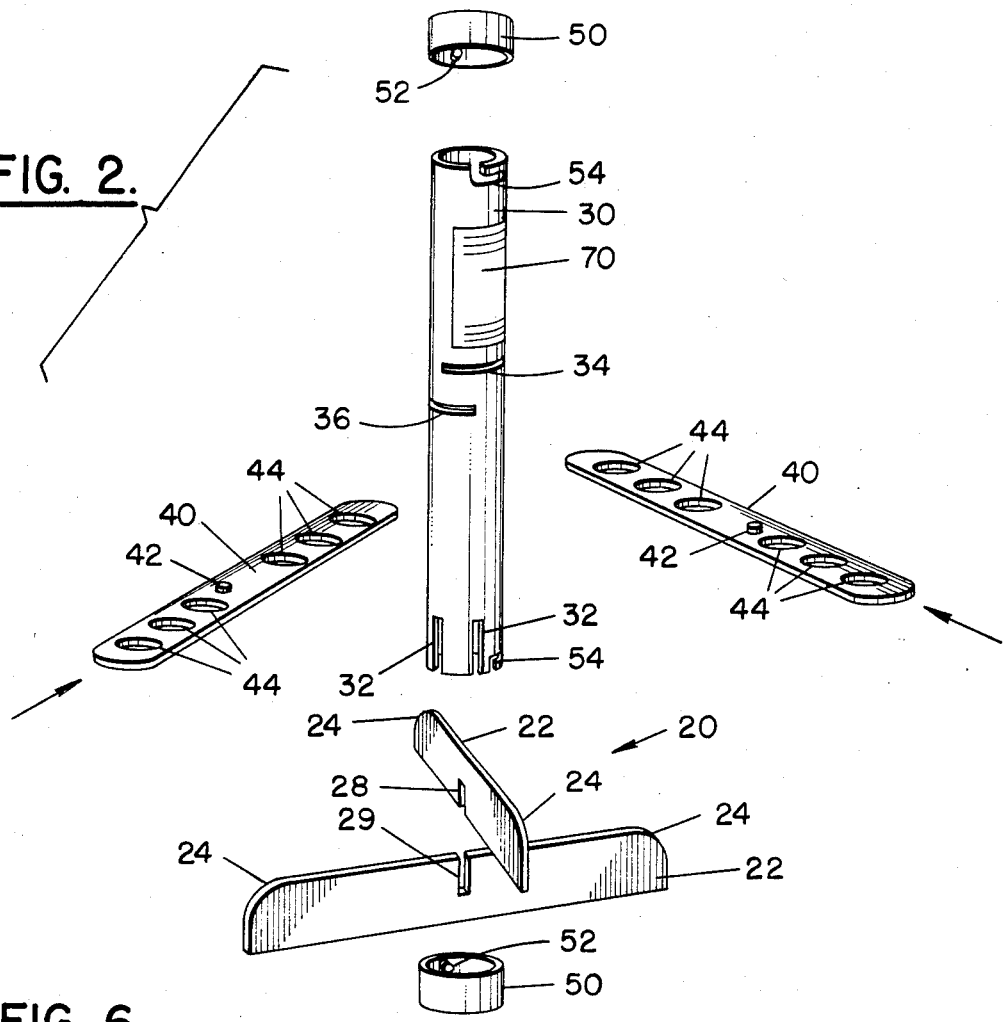
FIG. 2 is an exploded view of the disassemblable stand of FIG. 1 with an additional lower end cap.

Turning to FIG. 2, the disassemblable stand 10 is shown in an exploded format. It can be readily appreciated that the cross leg base 20 is formed of two elongated generally rectangularly shaped base leg pieces 22 with rounded ends 24. The ends 24 can optionally be provided with dig-in feet portions 26 (as shown in FIG. 5). The dig-in feet portions 26 have pointed or sharp configurations permitting the disassemblable stand to be held firmly by inserting the dig-in feet portions 26 into the surface on which the stand is resting. Centrally located in each of the elongated legs 22 are connected slots 28 and 29 extending normally to the longitudinal axis of the elongated legs 22. The connecting slots 28, 29 extend approximately halfway through the elongated legs 22 with connecting slot 28 extending from the bottom of its leg and connecting slot 29 extending from the top of its leg. The relative positions of connecting slots 28 and 29 permit the legs 22 to be interconnected forming the cross-shaped or X-shaped configuration of the base 20 shown in FIG. 1.

As can be appreciated from FIG. 2, the central tubular support member 30 is provided with two pairs of diametrically opposed longitudinally extending slots 32 (only one slot from each pair shown in FIG. 2) in its sidewall adjacent its lower end. The slots 32 are located ninety degrees from one another with the depth of the slots 32 equal to the height of the elongated leg pieces 28 and 29 when they are interconnected to form the cross leg base 20. The two pairs of diagonally opposed longitudinally extending slots 32 are positioned to permit the main tubular support member 30 to be seated on and interconnected with the cross leg base 20. The width of the slots 32 is approximately equal to the thickness of the elongated legs 22 so that a press or force fit is achieved between the base 20 and the central tubular support member 30.

Figure 3:
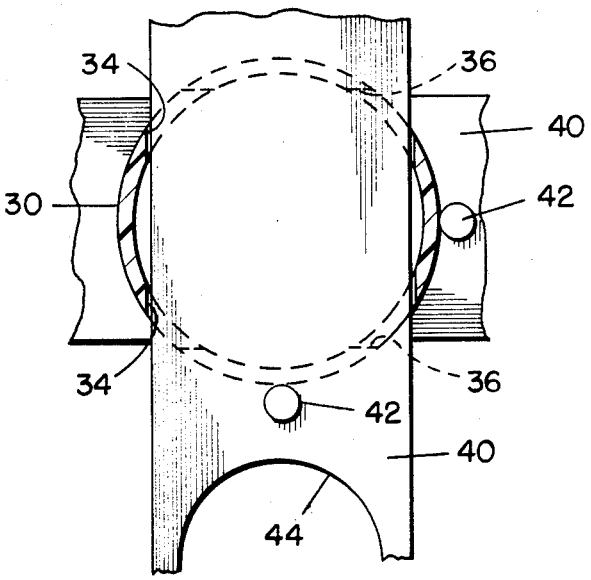
FIG. 3 is a fragmentary cross-sectional view taken along a line just above the first arm piece of FIG. 1 illustrating the abutment lugs for centering the extending arm pieces.
Figure 6:
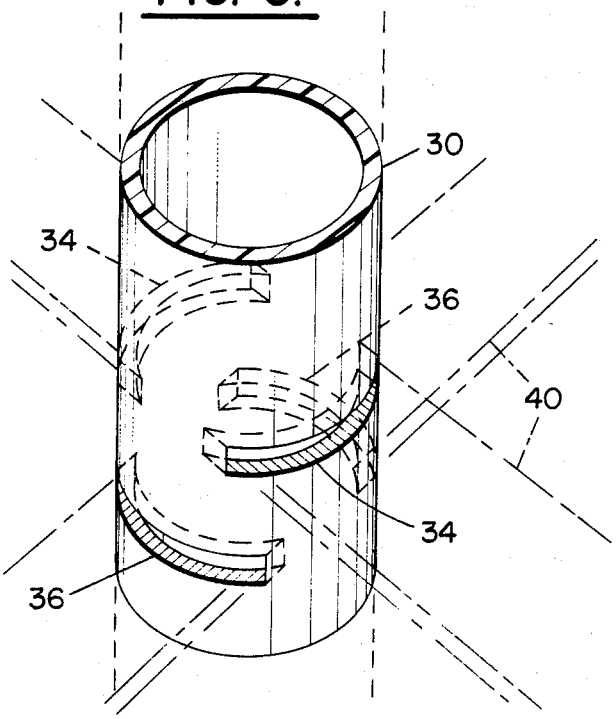
FIG. 6 is a fragmentary perspective view of the central support tube illustrating the upper and lower sector slots for the extending arm pieces shown in phantom line.
Figure 7:
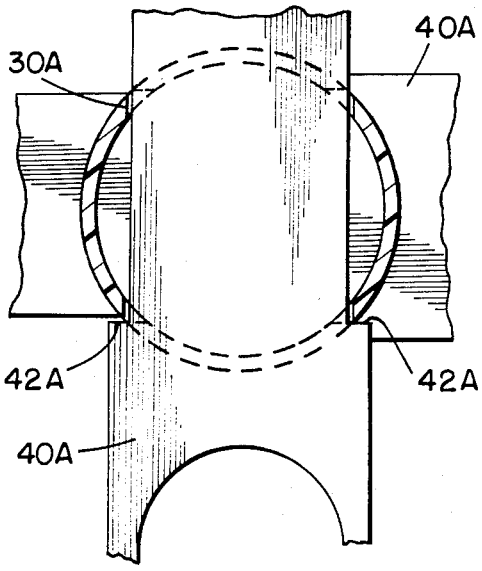
FIG. 7 is a fragmentary cross-sectional view similar to FIG. 4 but of a second embodiment provided with arm pieces with enlarged portions for centering purposes.

Formed in a central portion of the sidewall of the tubular support member 30 along a portion of the circumference thereof are spaced circumferential upper and lower sector slots 34 and 36. The sector slots 34 and 36 are in pairs with the slots in each pair diametrically opposed and dimensionally sized to accept its associated arm piece 40 and position it in a horizontal manner as seen in FIGS. 1, 3 and 6. Each of the arm pieces 40 are provided with upstanding abutment lugs 42 permitting the arm 40 to be slid into its associated pair of sector slots 34, 36 and accurately centrally located with respect to the central tubular support member 30 with equal portions of the arms extending on either side thereof. Another form of abutment means is shown in FIG. 7 where the widths of arms 40A are enlarged to form shoulders 42A to abut the tubular support member 30A and centrally locate the arms 40A relative thereto.

The arm pieces 40 are also provided with a plurality of circular bat positioning apertures 44 located along the longitudinal axis thereof. These apertures are preferably at least 2¾" in diameter to accommodate the largest bat diameter in either the game of softball or baseball. Each arm preferably can have either four or six apertures 44 thereby providing either an eight or twelve bat stand. It should be noted that the ends of the arms 40 are rounded to provide a smooth non-obtrusive surface.

The disassemblable stand 10 includes a pair of caps 50 for insertion over the ends of the central tubular support member 30. Each cap 50 is provided with a round detent 52 on its inner surface which cooperates with an associated L-shaped slot 54 in each end of the tubular support member 30 providing a bayonet-type connection between the caps 50 and the tubular support member 30. In use, the caps 50 can be inserted over each of the ends of the tubular support member 30 with detents 52 twisted into the L-shaped slots 54 to releasably connect the end caps 50 to the tubular support member 30. It should be readily appreciated by those skilled in the art that other types of releasable connections such as force fit or threaded connections could be utilized to connect the caps 50 to the tubular support member 30. Furthermore, both caps 50 are used only when the stand 10 is in its disassembled state as will be explained hereinafter.

In use, the disassemblable stand 10 is free-standing as shown in FIG. 1 and does not have to be hung or placed in close proximity to a wall, fence or backstop. Convniently, the disasemblable stand 10 can be placed in the "on-deck" batter area, inside dugouts and any location in close proximity thereto. Th disassemblable stand 10 takes up very little area as the eight bat holder is approximately twenty-four inches (24") in diameter while the twelve bat holder is approximately twenty-nine (29") in diameter. As shown in FIG. 1, the bats can be placed in the bat positioning apertures 44 with the butt ends resting on the ground therby serving to further stabilize the disassemblable stand 10. In this position, the length indicating indicia on the handle end of the bats is readily available for easy viewing thereby facilitating bat selection by the batter.

When it is desired to store or transport the disassemblable stand 10, once the bats 60 are all removed, the arm pieces 40 can be pulled from the upper and lower sector slots 34 and 36 in the tubular support member 30 while the cross leg pieces 22 can be removed from the slots 32 therein. Desirably, the arm pieces 40 and the cross leg pieces 22 are dimensionally sized to fit within the tubular support member 30. By inverting the tubular support member 30, once the leg pieces 20 and arm pieces 40 are are disassembled therefrom, the leg pieces 30 and arm pieces 40 can be inserted through the lower end into the confines of the tubular support member 30. The second end cap 50 can be applied to the end of the tubular support member to completely enclose the disassembled pieces.

The disassemblable stand 10 is preferably made from a high-impact plastic resin such as polyvinylchloride, polyethylene or polypropylene but it should be apparent to those skilled in the art that it may be manufactured from other suitable materials such as rubber, metal, wood, composite materials or any combination thereof, to produce a portable light-weight stand.

In addition, team logos, instructions or advertising can be put on the cap or body of the disassemblable stand 10 as indicated by numeral 70, or on any of the other components if desired. The disassemblable stand 10 also serves as a holder of batting helmets or various other equipment when they are placed on the ends of the bats located in the bat positioning apertures 44. Moreover, the stand serves as an attractive in-store, point-of-purchase display rack for bats and related accessories, utilizing available space efficiently to display numerous items.

Thus, it can be seen from the foregoing specification and attached drawings that the disassemblable stand of the present invention, in its assembled condition, provides a unique means for supporting baseball bats and, in its disassembled storage condition, the dissemblable stand can easily fit into a canvas duffel bag usually used to transport and store baseball bats and other equipment. The central tubular support member with its rounded corners will not damage the bats and equipment located in the canvas duffel bag or the duffel bag itself.

The preferred embodiment described above admirably achieves the objects of the invention; however, it will be appreciated that the departures can be made by those skilled in the art without departing from the spirit and scope of the invention which is limited only by the following claims.

What is claimed is:

1. A disassemblable stand for supporting baseball bats and the like, said stand comprising:

A. a base adapted to rest on a horizontal surface;

B. a main support member releasably mounted on and extending generally vertically from said base; and C. at least one arm piece releasably mounted and extending outwardly from said main support member, said at least one arm piece having means thereon to confine at least one baseball bat in a generally vertical position with each of the baseball bats having its butt end resting on the horizontal surface to further stabilize the stand.

2. The disassemblable stand in accordance with claim 1, wherein one of said base, said main support member and said arm piece has a compartment therein.

3. A disassemblable stand for supporting baseball bats and the like, said stand comprising:

A. a base adapted to rest on a horizontal surface;

B. a main support member releasably mounted on and extending generally vertically from said base; and C. at least one arm piece releasably mounted and extending outwardly from said main support member, said at least on arm piece having means thereon to support at least one baseball bat in a generally vertical position, wherein one of said base, said main support member and said arm piece has a compartment therein, and the other two of said base, said main support member and said arm piece are dimensionally sized to fit within said compartment.

4. A disassemblable stand for supporting baseball bats and the like, said stand comprising:

A. a base adapted to rest on horizontal surface;

B. a main support member releasably mounted on and extending generally vertically from aid base; and C. at least one arm piece releasably mounted and extending outwardly from said main support member, said at least one arm piece having means thereon to support at least one baseball bat in a generally vertical position, wherein said main support member has a compartment therein, and said base and arm piece are dimensionally sized to fit within said compartment whereby said base, main support member and arm piece can be disassembled from one another and said base and arm piece inserted within said compartment of said main support member.

5. The disassemblable stand in accordance with claim 4, wherein said main support member is a tubular support member and said compartment is a hollow central portion thereof.

6. The disassemblable stand in accordance with claim 4, wherein said main support member has at least one slot therethrough and said arm piece extends through said one slot and outwardly on either side of said main support member.

7. The disassemblable stand in accordance with claim 1, wherein said at least one arm piece comprises two elongated arm pieces releasably mounted on and extending outwardly from said main support member.

8. The disassemblable stand in accordance with claim 7, wherein said two arm pieces are spaced vertically from one another on said main suppport member.

9. The disassemblable stand in accordance with claim 8, wherein said two arm pieces are oriented at right angles relative to one another.

10. The disassemblable stand in accordance with claim 1, wherein said base is provided by two cross leg members on which said main support member is releasably seated.

11. The disassemblable stand in accordance with claim 10, wherein said cross leg members are oriented at ninety degree angles to one another and at forty-five degree angles relative to said arm piece.

12. The disassemblable stand in accordance with claim 10, wherein said main support member is provided with slots at its lower end and said cross leg members fit into said slots to form a releasable connection between said main support member and said cross leg members.

13. The disassemblable stand in accordance with claim 1, wherein said main support member is a tubular support member, said base is provided by two cross leg members, and said arm piece is two elongated arm pieces.

14. A disassemblable stand for supporting baseball bats and the like, said stand comprising:

A. a base adapted to rest on a horiziontal surface;

B. a main support member releaseable mounted on and extending generally vertically from said base; and C. at least one arm piece releasably mounted and extending outwardly from said main support member, said at least one arm piece having means thereon to support at least one baseball bat in a generally vertical position, wherein said main support is a tubular support member, said base is provided by two cross leg members, and said arm piece is two elongated arm pieces, said two cross leg members and said two elongated arm pieces are dimensionally sized to fit within said tubular support member whereby said main support member, two cross leg members and two arm pieces can be disassembled from one another and said cross leg members and arm pieces can be inserted in said tubular support member.

15. The disassemblable stand in accordance with claim 1, further including cap means covering end of said main support member.

16. The disassemblable stand in accordance with claim 15, wherein said cap means has a locking device thereto to lock said cap means to said main support member.

17. The disassemblable stand in accordance with claim 1, wherein said arm piece has apertures therein in which baseball bat can be positioned thereby providing said supporting means for said baseball bat.

18. A kit for forming a portable stand for baseball bats and the like capable of being assembled in the field, and kit comprising the combination of:

A. a base adapted to rest on a horizontal surface;

B. a main support member adapted to be releasably mounted on and extend vertically from said base, and C. at least one arm piece adapted to be releasably mounted and extend outwardly from said main support member, said arm piece having means thereon to confine baseball bats in a generally vertical position with each of the baseball bats having its butt end resting on the horizontal surface to further stabilize the stand.

19. The kit in accordance with claim 18, wherein one of said base, said main support member and said arm piece has a compartment therein.

20. A kit for forming a portable stand for baseball bats and the like capable of being assembled in the field, the kit comprising the combination of:

A. a base adapted to rest on a horizontal surface;

B. a main support member adapted to be releasably mounted on and extend vertically from said base; and C. at least one arm piece adapted to be releasably mounted and extend outwardly from said main support member, said arm piece having means thereon to support baseball bats in a generally vertical position, wherein one of said base, said main support member and said arm piece has a compartment therein, and the other two of said base, said main support member and said arm piece are dimensionally sized to fit within said compartment.

21. A kit for forming a portable stand for baseball bats and the like capable of being assembled in the field, the kit comprising the combination of:

A. a base adapted to rest on a horizontal surface;

B. a main support member adapted to be releasably mounted on and extend vertically from said base; and C. at least one arm piece adapted to be releasably mounted and extend outwardly from said main support member, said arm piece having means thereon to support baseball bats in a generally vertical position, wherein said main support member has a compartment therein, and said base and arm piece are dimensionally sized to fit within and are located within said compartment.

22. The kit in accordance with claim 21, wherein said main support member is a tubular support member and said compartment is a hollow central portion thereof.

23. The kit in accordance with claim 21, wherein said main support member has at least one slot therethrough and is adapted to receive said arm piece through said slot to extend outwardly on either side of said main support member.

24. The kit in accordance with claim 18, wherein said arm piece comprises two elongated arm pieces adapted to be releasably mounted on and extend outwardly from said main support member.

25. The kit in accordance with claim 24, wherein said main support member and said two arm pieces are adapted so said arm pieces may be spaced vertically from one another on said main support member.

26. The kit in accordance with claim 25, wherein said two arm pieces may be oriented in said main support member at right angles relative to one another.

27. The kit in accordance with claim 18 wherein said base is provided by two cross leg members on which said main support member may be releasably seated.

28. The kit in accordance with claim 27, wherein said cross leg members may be oriented at ninety degree angles relative to one another and at forty-five degree angles relative to said arm piece when inserted in said main support member.

29. The kit in accordance with claim 27, wherein said main support member is provided with slots at its lower end and said cross leg members are adapted to be fit into said slots to form a releasable connection between said main support member and said cross leg members.

30. The kit in accordance with claim 18, wherein said main support member is a tubular support member, said base is provided by two cross leg members, and said at least one arm piece is two elongated arm pieces.

31. A kit forming a portable stand for baseball bats and the like capable of being assembled in the field, the kit comprising the combination of:

A. a base adapted to rest on a horizontal surface;

B. a main support member adapted to be releasably mounted on and extend vertically from said base; and C. at least one arm piece adapted to be releasably mounted and extend outwardly from said main support member, said arm piece having means thereon to support baseball bats in a generally vertical position, wherein said main support member is a tubular support member, said base is provided by two cross leg members, and said at least one arm piece is two elongated arm pieces, said two cross leg members and said two elongated arm pieces are dimensionally sized to fit within and are located within said tubular support member.

32. The kit in accordance with claim 18, further including cap means adapted to cover at least one end of said main support member.

33. The kit in accordance with claim 32, wherein said cap means has a locking device thereon to lock said cap means to said main support member.

34. The kit in accordance with claim 18, wherein said arm piece has apertures therein in which at least one baseball bat can be positioned thereby providing said supporting means for said baseball bat.

35. A disassemblable stand for supporting baseball bats and the like, said stand comprising:

A. a base adapted to rest on a horizontal surface;

B. a main support member releasably mounted on and extending generally vertically from said base, said main support member having sector slots therethrough, said slots being dimensionally sized to accept an arm piece; and C. two arm pieces releasably mounted within said sector slots and extending through said main support member with equal portions of said arms extending on either side thereof, each of said arm pieces having means thereon to support at least one baseball bat in a generally vertically position thereby further stabilizing the stand.

36. The disassemblable stand in accordance with claim 35, wherein said main support member has a tubular configuration and said sector slots are pairs of sector slots, said slots in each pair being diametrically opposed to one another.

37. The disassemblable stand in accordance with claim 35, wherein said two arm pieces are provided with abutment surfaces to abut said main support member and centrally locate said arms relative thereto.

38. The disassemblable stand in accordance with claim 35, wherein said two arm pieces are spaced vertically from one another through said main support member.

39. The disassemblable stand in accordance with claim 38, wherein said two arm pieces are oriented at right angles relative to one another.

40. The disassemblable stand in accordance with claim 35, wherein said base is provided by two cross leg members on which said main support member is releasably seated.

41. The disassemblable stand in accordance with claim 40, wherein said cross leg members are oriented at ninety degree angles to one another and at forty-five degree angles relative to said arm pieces.

42. A kit for forming a portable stand for baseball bats and the like capable of being assembled in the field, the kit comprising the combination of:

A. a base adapted to rest on a horizontal surface;

B. a main support member adapted to be releasably mounted on and extend vertically from said base, said main support member having sector slots therethrough, said slots being dimensionally sized to accept an arm piece; and C. two arm pieces adapted to be releasably mounted within said sector slots and extend through said main support member with equal portions of said arms extending on either side thereof, each of said arm pieces having means thereon to support baseball bats in a generally vertical position thereby further stabilizing the stand.

43. The kit in accordance with claim 42, wherein said main support member has a tubular configuration and said sector slots are pairs of sector slots, said slots in each pair being diametrically opposed to one another.

44. The kit in accordance with claim 42, wherein said two arm pieces are provided with abutment surfaces adapted to abut said main support member and centrally locate said arms relative thereto.

45. The kit in accordance with claim 42, wherein said main support member said slots, and said two arm pieces are adapted so said arm pieces may be spaced vertically from one another through said main support member.

46. The kit in accordance with claim 45, wherein said two arm pieces may be oriented through said slots in said main support member at right angles relative to one another.

47. The kit in accordance with claim 42 wherein said base is provided by two cross leg members on which said main support member may be releasably seated.

48. The kit in accordance with claim 47, wherein said cross leg members may b oriented at ninety degree angles relative to one another and at forty-five degree angles relative to said arm pieces when inserted in said main support member.

* * * * *

UNITED STATES PATENT AND TRADEMARK OFFICE

CERTIFICATE OF CORRECTION

PATENT NO. : 4,807,763

DATED : February 28, 1989

INVENTOR(S) : Peter Jankovsky

It is certified that error appears in the above—identified patent and that said Letters Patent is hereby corrected as shown below:

Column 6, line 3, change "aid" to --said--.
Column 6, line 57, change "releasable" to --releasably--.
Column 7, line 12, change "thereto" to --thereon--.
Column 10, line 34, change "b" to --be--.
Column 4, line 40, change "Convniently" to --Conveniently--.
Column 4, line 49, change "therby" to --thereby--.

Signed and Sealed this

Fifteenth Day of August, 1989

*Attest:*

*Attesting Officer*

DONALD J. QUIGG

*Commissioner of Patents and Trademarks*